United States Patent [19]

Mohri

[11] 4,151,074

[45] Apr. 24, 1979

[54] WET-TYPE SAND CLASSIFIER

[75] Inventor: Takuo Mohri, Miyazaki, Japan

[73] Assignee: Akae Kikai Kogyo Co. Ltd., Miyazaki, Japan

[21] Appl. No.: 808,217

[22] Filed: Jun. 20, 1977

[51] Int. Cl.[2] ..... B03B 5/56

[52] U.S. Cl. ..... 209/44; 209/156; 209/294; 209/452; 209/482

[58] Field of Search ..... 209/156, 293, 155, 451, 209/452, 498, 492, 3, 270, 273, 304, 306, 293, 294, 17, 44; 210/326, 330, 335

[56] References Cited

U.S. PATENT DOCUMENTS

| | | | |
|---|---|---|---|
| 1,917,300 | 7/1933 | Hardinge | 209/452 |
| 2,047,202 | 7/1936 | Hardinge et al. | 209/452 |
| 2,119,414 | 5/1938 | Blanchard | 209/452 |
| 2,836,299 | 5/1958 | Johnson | 209/270 |
| 3,556,498 | 1/1971 | Sheahan | 432/118 |
| 4,055,487 | 10/1977 | Moori | 209/494 |

FOREIGN PATENT DOCUMENTS 49-78829 7/1974 Japan.

*Primary Examiner*—Robert Halper
*Assistant Examiner*—Jon E. Hokanson
*Attorney, Agent, or Firm*—Frank J. Jordan

[57] ABSTRACT

A rotary drum-type sand classifier of this invention is provided with a desired number of rows of sand discharging mechanisms at the rear end thereof.

Between each pair of sand discharging mechanism, a water cleaning chamber is formed where the classified sand is cleaned with water fed from the rear outlet of the drum. Due to the above construction, the sand classifier of this invention can conduct the classifying and cleaning of sand to be produced simultaneously and efficiently.

8 Claims, 9 Drawing Figures

20
8'
9
21
1
12'
29 a
b
c
F

WET-TYPE SAND CLASSIFIER

BACKGROUND OF INVENTION

This invention relates to a drum-type classifier which is characterized by having water separation paddles disposed coaxially one subsequent to the other at the sand discharge end of the drum.

Although when classifying sand, separation into uniform particle sizes is necessary, decreasing the amount of mud remaining in the classified sand is also important in improving the quality of the sand since the above quantity of mud will influence the strength of the concrete produced using the sand.

For the purpose of improving the above quality, conventional classifiers have had various kinds of improvements in the water separation paddles. However, since the sand is scooped from muddy water, the removal of the mud in the classified sand cannot be thoroughly achieved.

The inventor of this application has already disclosed in U.S. Pat. No. 4,055,487 a rotary-type sand classifier which can efficiently classify the sand of desired particulate size distribution. However, this apparatus cannot achieve the sufficient removal of mud.

It is especially difficult to decrease the quantity of mud in the final product when minute sand particles must be classified from very muddy water.

Accordingly, it is an object of the present invention to provide a rotary drum-type sand classifier for resolving the aforementioned problems which is characterized by having two rows of water separation paddles disposed coaxially with one subsequent to the other at the rear of the rotary drum. In short, the mud component contained in the classified sand is drastically decreased by the combination of the first ring of water separation paddles which scoop the minute sand particles from water containing a relatively large quantity of mud and the second ring of separation paddles which are disposed subsequent to the above first separation paddles and which clean the classified sand with the water.

It is another object of the present invention to provide a rotary drum-type sand classifier having a plurality of the above sand discharging mechanisms in rows at the rear end of the rotary drum which can further facilitate the cleaning of the classified sand.

DETAILED DESCRIPTION OF DISCLOSURE

Figure 1:
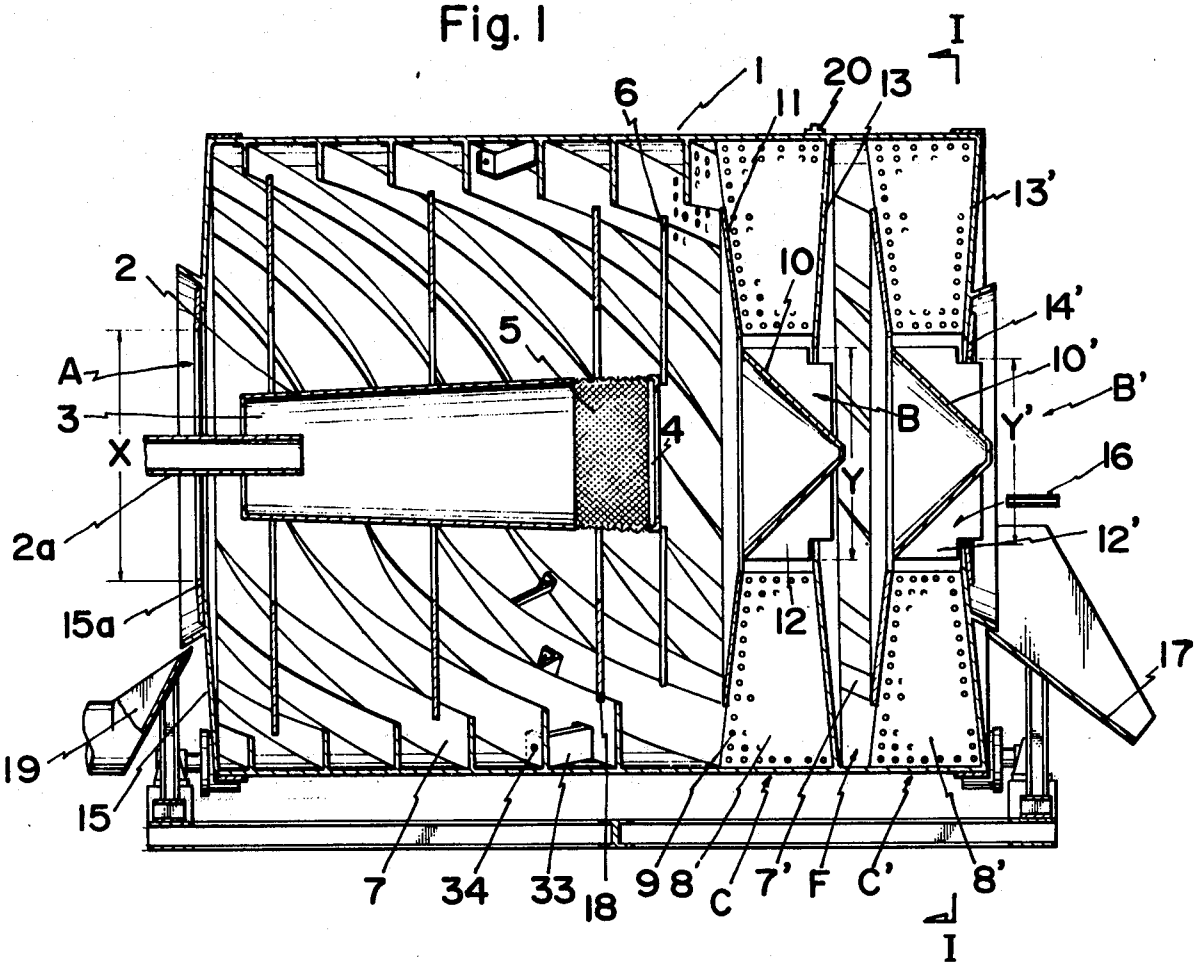
FIG. 1 is a transverse cross-sectional side view of a drum type sand classifier of this invention.

In this invention, as shown in FIG. 1, a rotary drum 1 encloses a feed pipe 2 which is concentric within the drum 1. The pipe 2 has an inlet 3 at the front end into which the muddy water is introduced by means of an introduction pipe 2*a* and an outlet 4 at the rear end. The rear end portion of the pipe has a plural number of apertures 5 which may be provided, for example, by fabricating the rear end portion of an expanded metal mesh. The diameter of the pipe 2 gradually increases from the front end to the rear end. Furthermore the pipe 2 is supported by a plurality of frames 6 which extend radially from the outer surface of the rear end of the pipe 2 with one end of the respective frames 6 being secured to the rear of the pipe 2 and the other end of the respective frames 6 being secured to the upper portion of the respective helicoid blades 7. A plurality of helicoid blades 7 of the same pitch are fixedly secured to the entire inner surface of the drum 1 at regular intervals except at the rear end of the drum 1.

At the rear end of the drum 1, a first settled sand discharge mechanism C is provided wherein a plurality of water separation paddles 8 are radially disposed with their distal ends secured to the inner surface of the drum 1. Each paddle 8 has a number of apertures 9. A cone-shaped chute 10 is concentric with and located at the rear end of the drum 1 forming an integral part of the drum 1 with the base of the conical shape being secured to the circular side plate 11 which in turn has an inclined surface secured to the sides of the paddles 8. A plurality of partitions 12 are fixedly mounted on the inclined face of the conical chute 10. A circular weir plate 13 which is disposed at the rearmost portion of the drum 1 has an inclined surface secured to the sides of the paddles 8. B indicates an outlet from which classified sand is discharged.

At the rear portion of the settled sand discharge mechanism C and in the axial direction of the drum 1, another settled sand discharge mechanism C′ which has a similar construction to mechanism C is disposed coaxially with mechanism C, wherein parts corresponding to the parts of mechanism C are designated by the same numerals with a prime on the shoulder thereof. This mechanism C is further provided with an auxiliary circular adjustable plate 14′ which is removably mounted on the outer periphery of a circular weir plate 13′ forming a part of weir plate 13′.

In the above construction, the central openings B, B′ of the circular weir plates 13, 13′ have inner diameters Y, Y′ which are smaller than the diameter X of the opening A of the ring-like weir plate 15. The above diameter Y′ is further smaller than the diameter Y although the diameter Y′ can be the same as the diameter Y in some cases.

Furthermore, the helicoid blades 7′ can be employed between the discharge mechanisms C and C′ so that the settled product discharged by the settled sand discharge mechanism C is transferred to the next settled product discharge mechanism C′ smoothly.

A clean water supply tube 16 is disposed within the settled sand discharge opening B′ from the outside of the drum 1 such that clean water is supplied to the settled sand cleaning portion F which is enclosed between the circular weir plates 13 and 13′ and the inner peripheral wall of the rear portion of the drum 1 where the settled sand is cleaned.

A sand discharge chute 17 which receives the classified and cleaned sand from the settled sand discharge opening B' is secured to the outside of the rear end of drum 1.

Referring to other parts of the sand classifier of this invention, a plurality of ring-like baffle plates 18 are disposed along the length of drum 1 at regular intervals. The outer portion of each baffle plate 18 is attached to a helicoid blade 7 while the inner portion remains free and extends toward the central axis of the drum 1. A indicates an outlet through which the supernatant water is carried to a water discharge chute 19. The discharged supernatant water is delivered to a reservoir by a suitable means such as a pump (not shown in drawings). Numeral 15*a* indicates an adjustable circular plate which is removably mounted on the front of plate 15, the outer periphery of which in turn is secured to the frontmost edge of the drum 1.

Figure 2:
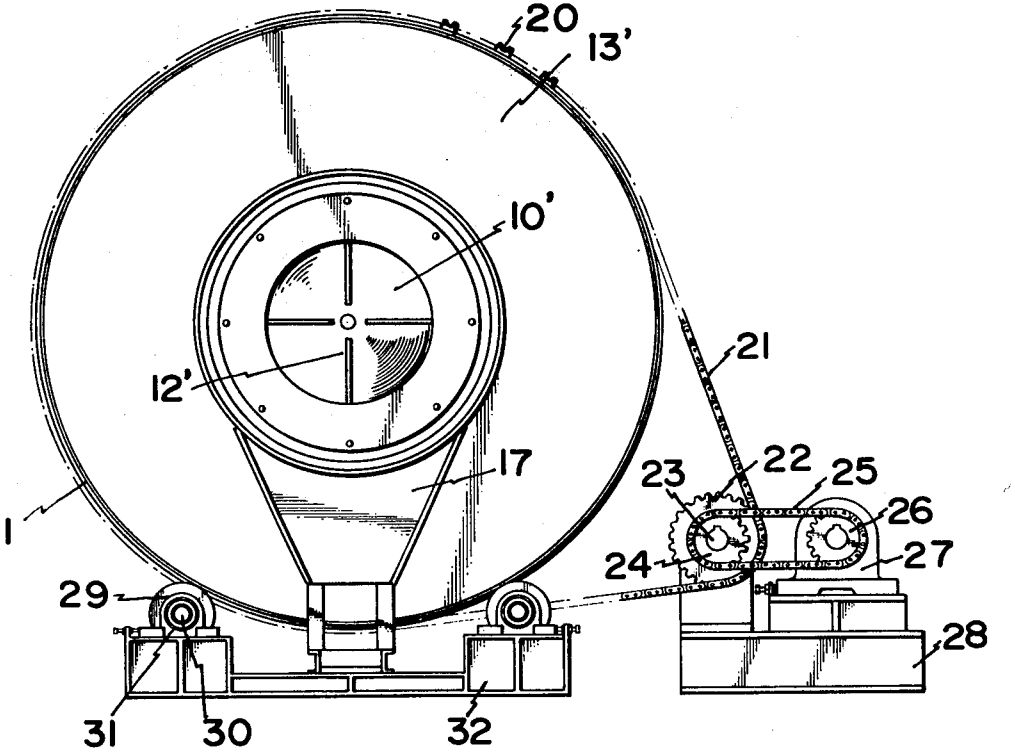
FIG. 2 is a rear end view of the above sand classifier.
Figure 3:
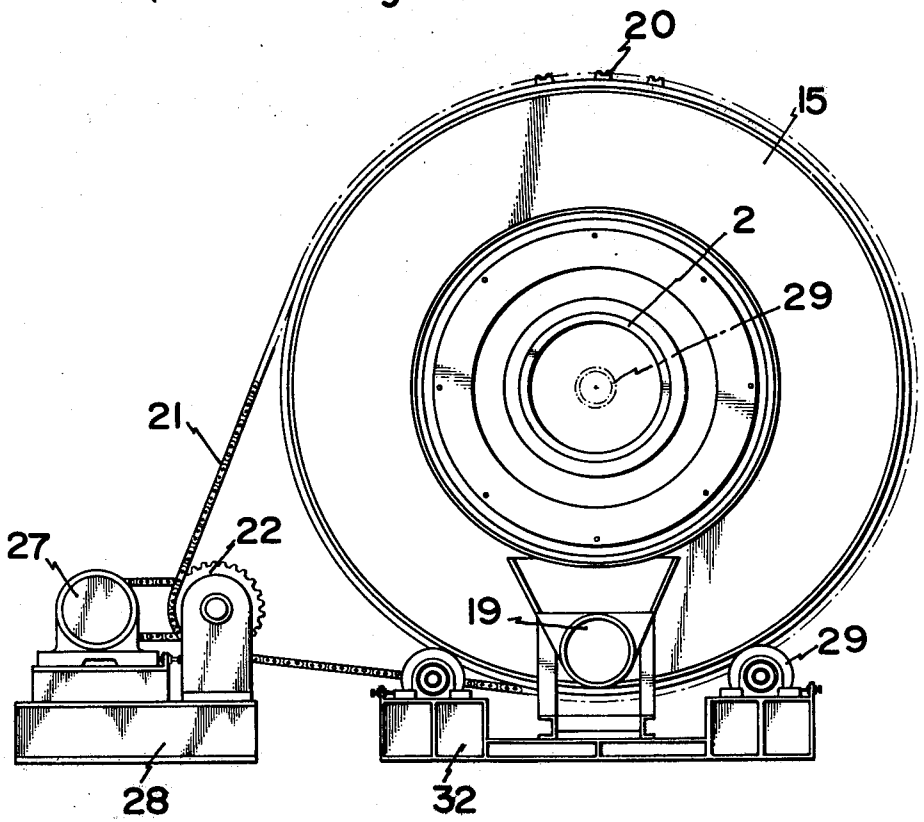
FIG. 3 is a front end view of the above sand classifier.

With reference to FIG. 2 and FIG. 3, a plurality of teeth 20 are fixedly attached to the outer circumference at the midsection of the drum 1. An endless chain 21 is extended between the drum 1 and a first sprocket wheel 22 which is fixedly mounted on a shaft 23. Numeral 25 indicates an endless chain which is extended between the second sprocket wheel 24 and a third sprocket wheel 26 that is fixedly mounted on a shaft of a motor 27. Numeral 28 indicates a base on which the above sprockets and the motor 27 are mounted. The drum 1 is rotatably supported by plural pairs of rollers 29. Each roller 29 is fixedly mounted on shafts 30 which have both ends journal mounted in bearings 31. Bearings 31 are fixedly mounted on a frame structure 32. Referring back to FIG. 1, a plurality of blockade plates 33 are shown which are disposed along the inner circumference of the drum at required longitudinal positions, wherein each plate 33 is inserted between two helicoid blades 7 and has both sides secured to the side edge of the blades 7 by bolts 34. The height of the plates 33 is half that of the blades 7.

The manner in which the apparatus is operated is hereinafter described with reference to the individual operation of the parts of the apparatus.

Figures 4, 5:
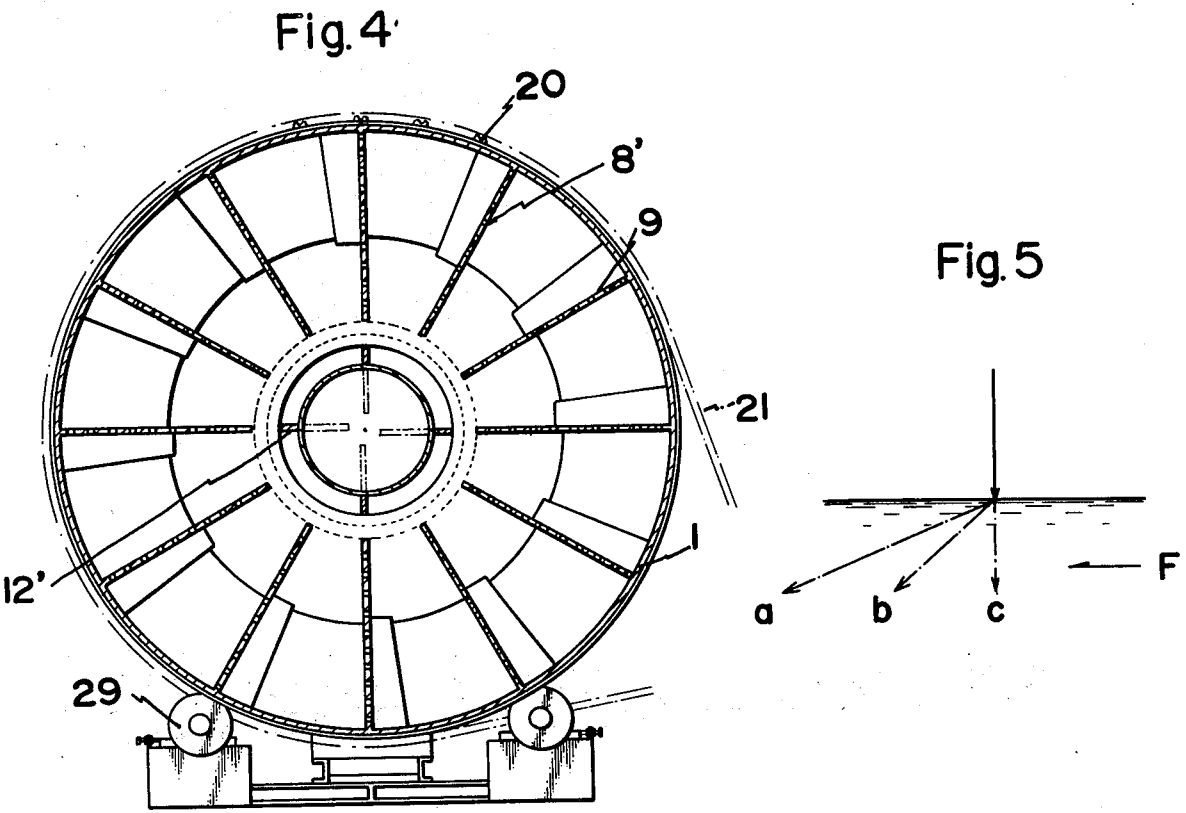
FIG. 4 is a longitudinal cross-sectional view of the above sand classifier taken along the line I—I.
FIG. 5 is a schematic view showing the direction of a falling particle in the water.

In FIG. 1 and FIG. 2, the muddy water which contains sand is continuously supplied to the front inlet 3 of the feed pipe 2 while the drum 1 is rotated slowly by the motor 27. Since the feed pipe 2 has a diameter which gradually and continuously increases toward the rear end of the pipe 2 and also has numerous apertures 5 at the rear end of the pipe 2, the muddy water which is introduced into the pipe 2 passes through the apertures 5 and is dispersed downwardly into the drum 1. Some of the remaining flow of water may pass downward from the outlet of the pipe. Therefore, the muddy water loses flow energy or velocity and no vortices, which would prevent the sand from settling, occur at the point where the falling water hits the surface of the water in the drum 1. Accordingly, the sand is allowed to settle within the drum 1 resulting in improvement of the classification. The muddy water is then forced to overflow the plurality of ring-like baffle plates 18 and move towards the water discharge outlet A located at the front end of the drum 1. During the above mentioned movement of the muddy water in the direction of the water discharge outlet A, sand particles which have a specific gravity that is greater than that of water settle onto the bottom of the drum 1, bumping into the baffle plates 18 and losing their flow energy. The settled sand is then transferred by the rotation of the helicoid blades 7 to the rear end of the drum 1 where a plurality of paddles 8 are disposed. Each helicoid blade 7 may have many apertures at the rear portion so that it can move smoothly with reduced flow resistance to the water. Furthermore, the movement of sand containing some settled mud towards the discharge outlet A is prevented by a number of blockade plates 33 where the blockaded sand is moved along the inner surface of the drum 1 by the rotation of the drum 1. When the sand is transferred to the "top dead point" where it slides into the blockade plates 33, the sand falls onto the upper portion of the feed pipe 2 and then is scattered into the water. The scattered sand or mud components move in one of the directions in the water as shown in FIG. 5 depending on the size and specific gravity of the sand, wherein a indicates the direction of mud particles; b the direction of minute sand particles; c the direction of coarse particles and F the flow direction of the muddy supernatant water. By the repetition of the above actions where the effect is proportional to the number of blockade plates 33 are attached, the particle size distribution of the classified sand is adjustable. Then, as the sand is moved along the inner surface of the drum 1 towards the upper portion due to the rotation of the drum 1, the water which is transported along with the sand is considerably eliminated through a number of apertures 9 in each paddle 8. When the sand which is substantially free of water is transferred to a location directly above the cone-shaped discharge means 10, the sand is cast onto the inclined surface of the discharge means 10.

Since a necessary number of partitions 12 are fixedly secured to the inclined surface of the discharge means 10 the sand slides along the inclined surface and is discharged from the discharge outlet B. The settled sand such as minute sand which is discharged by the settled sand discharge mechanism C still contains a sizeable quantity of mud at this stage of operation since the water separation paddles 8 rotate in water which contains a great quantity of mud.

However, due to two rows of sand discharge mechanisms set forth heretofore, if this settled sand is charged into a settled sand cleaning portion F, which is enclosed by the circular weir plates 13 and 13' and the rear portion of the drum 1, the mud components which adhere to the minute sand particles are washed away by the clean water which is charged through the clean water supply tube 16 with the clean settled sand discharged from the outlet B' of the drum 1 by the settled product discharge mechanism C' which is similar in construction to mechanism C. Furthermore, since the settled sand discharge openings B and B' of the circular weir plates 13 and 13' have a smaller diameter than that of the supernatant water discharge opening A, muddy water with a smaller amount of mud is discharged back into the rotary drum 1 from the settled sand cleaning portion F overflowing the circular side plate 11 so that the density of the mud component of the water in the portion F is maintained at a very low level whereby the quantity of mud contained in the classified minute sand, is lowered to the extremely low percentage of less than one percent.

Meanwhile, the supernatant water, which is the remainder of the muddy water after the sand of the required size range has settled onto the bottom of the drum 1, overflows out the discharge outlet A into the water discharge chute 19. The water is then transferred to a reservoir by suitable means such as a power-operated pump.

In this invention, the inventor describes a classifier which is capable of classifying as well as cleaning the sand by removing the mud component which exists in the classified sand. However, it should be noted that the apparatus of this invention is also applicable for use in classifying components which are settleable and are contained in other kinds of liquids.

As has been described heretofore, since the cleaning of classified sand is conducted simultaneously with the classifying operation, it is unnecessary to spend extra time cleaning the classified sand while improving the quality of the settled product.

Figure 6:
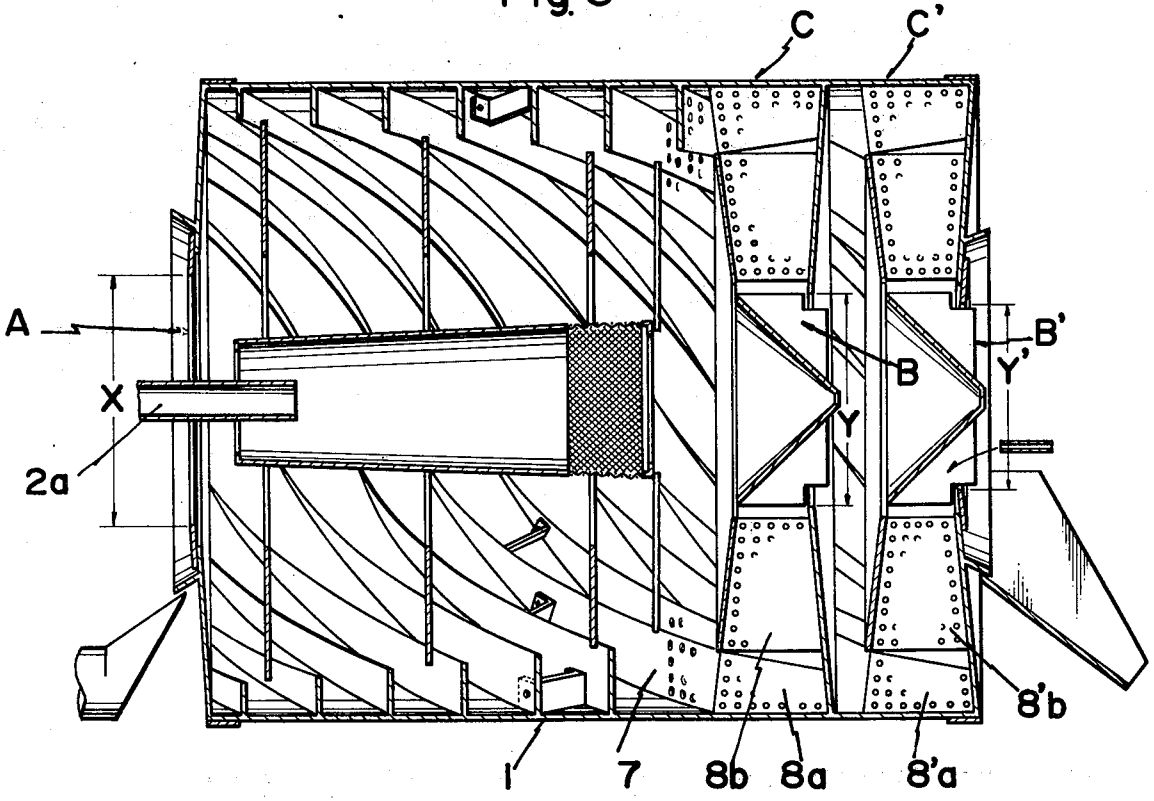
FIG. 6 is a transverse cross-sectional side view of a modification of the above sand classifier.

FIG. 6 shows a modification of the apparatus of this invention wherein the feature thereof is found in the construction or formation of scooping paddles 8 and 8'. As can be observed clearly in FIG. 6, each paddle 8 (8') is divided into a peripheral portion 8*a* (8*a'*) and a proximal portion 8*b* (8*b'*) wherein the peripheral portion 8*a* of the above scooping paddle 8 has a height equal to the height of the adjoining helicoid blade 7 and is also deflected at a desired angle away from the axial direction of the drum.

Figure 7:
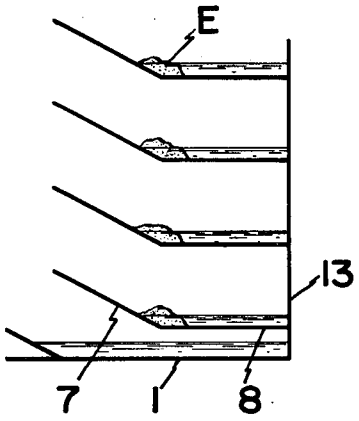
FIG. 7 and FIG. 8 are pictorial views showing the portion where the helicoid blades and the scooping paddles meet in view of the basic structure (FIG. 1) and the modified structure (FIG. 6).
Figure 8:
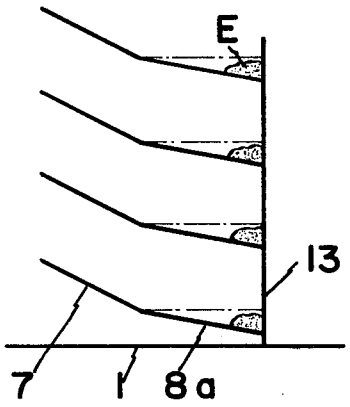

Due to the above construction of the helicoid blades as shown in FIG. 8, the angle formed by a helicoid blade 7 and the peripheral portion 8*a* of the scooping paddle 8 is approximately 180° so that the settled product E which is transferred from the helicoid blade 7 does not accumulate at the deflected area but accumulates at the deepest corner area formed by the scooping paddle 8, drum 1 and the circular weir plate 13. In other words, the so called "dam" which appears between the circular weir plate 13 and the accumulated settled product in the basic type of apparatus of this invention (FIG. 7) is not formed so that the water separation is effectively conducted.

Figure 9:
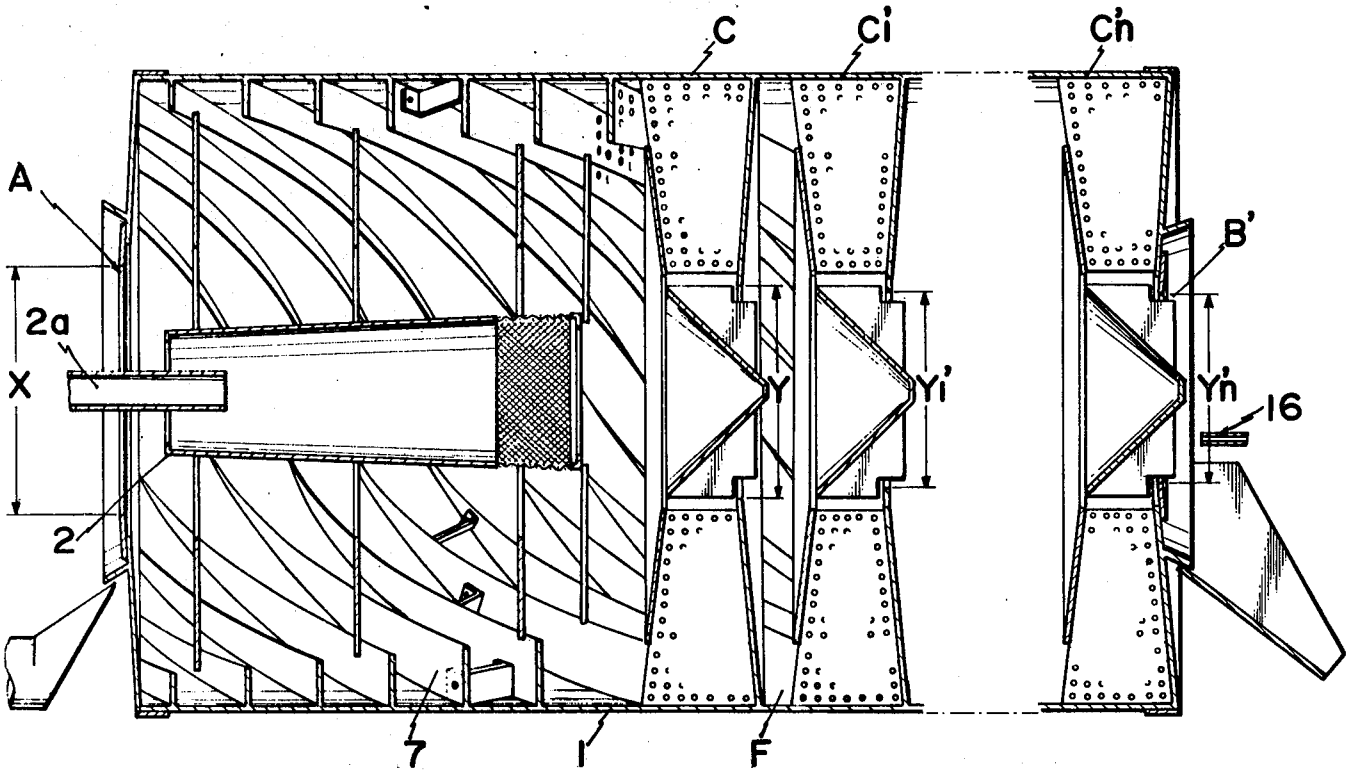
FIG. 9 is a transverse cross-sectional side view of another modification of the above sand classifier.

FIG. 9 shows another modification of the apparatus of this invention wherein a plurality of sand discharge mechanisms are provided in rows at the rear of the rotary drum 1.

Due to this construction, the cleaning of the classified sand is further enhanced.

What we claim is:

1. A wet type sand classifier comprising a rotary drum having a supernatant water outlet at the front end thereof and a classified sand outlet at the rear end thereof, a feeding means for feeding muddy water containing said sand into said drum, said feeding means being enclosed concentrically within said drum and attached to said drum for rotation with said drum, a transferring means for transferring sand settled onto the bottom of said rotary drum toward the rear portion of said drum, said transferring means comprising a plurality of helicoid blades fixedly secured to the inner wall of said drum, a plurality of rows of sand discharging mechanisms disposed at the rear end portion of said rotary drum, the rearmost discharging mechanism including said rear classified sand outlet, each pair of sand discharging mechanisms forming a sand cleaning chamber therebetween, each of said sand discharging mechanisms comprising a plurality of water separation paddles radially disposed about the inner periphery of said rotary drum, each of said paddles having apertures on the surface thereof for separating the water, and a cone-shaped chute having an exterior inclined surface which has a plurality of partitions fixedly secured to said inclined surface, a water feeding pipe having a feeding outlet disposed at one of said rows of sand discharging mechanisms to feed clean water to said sand cleaning chamber, whereby said clean water cleans the mud from the sand particles prior to discharge of the sand through the classified sand outlet, and a weir plate secured to the rear sides of the paddles, said weir plates each having a central opening, the diameters of each of said central openings of said weir plates being less than the diameter of said supernatant water outlet at the front end of the drum, such that the water in the sand cleaning chamber which contains mud components passes from the cleaning chamber towards the front end of the drum.

2. A wet-type sand classifier according to claim 1, further comprising a side plate secured to the front sides of the paddles, said side plates each having a central opening, said water containing mud components in the cleaning chamber and passing from the cleaning chamber towards the front of the drum also passing through said central opening of said side plates.

3. A wet-type sand classifier according to claim 1, wherein said sand cleaning chamber is formed between the weir plates of juxtaposed paddles and the rear portion of the drum, said water feeding pipe supplying clean water to said sand cleaning chamber whereby mud components adhering to the sand particles are washed by said clean water supplied by said water feeding pipe.

4. A wet-type sand classifier according to claim 1, wherein each of said paddles has a peripheral portion and a proximal portion, said peripheral portions being inclined relative to the axial direction of the drum.

5. A wet-type sand classifier according to claim 4, wherein said peripheral portions have a radial height corresponding to the radial height of said helicoid blades.

6. A wet-type sand classifier according to claim 4, wherein the angle formed by said peripheral portions of said paddles and said helicoid blades is approximately 180 degrees.

7. A wet-type sand classifier according to claim 1, wherein the diameter of the central opening of the weir plate disposed closest to the rear end of the drum is less than the diameter of the central opening of the weir plate disposed furthest from the rear end of the drum.

8. A wet-type sand classifier comprising:

a rotary drum having a supernatant water outlet at the front end thereof and a classified sand outlet at the rear end thereof, a feeding means for feeding muddy water containing said sand into said drum, said feeding means being enclosed concentrically within said drum and attached to said drum for rotation with said drum, a transferring means for transferring sand settled onto the bottom of said rotary drum toward the rear portion of said drum, said transferring means comprising a plurality of helicoid blades fixedly secured to the inner wall of said drum, a plurality of rows of sand discharging mechanisms disposed at the rear end portion of said rotary drum, the rearmost discharging mechanism including said rear classified sand outlet, each pair of said discharging mechanisms forming a sand cleaning chamber therebetween, said discharge mechanisms being axially spaced from one another, and second helicoid blades disposed in said spaced between said discharge mechanisms, whereby said second helicoid blades transfer settled matter from one discharge mechanism to the next, and a water feeding pipe having a feeding outlet disposed at one of said rows of said discharging mechanisms to feed clean water to said sand cleaning chamber, whereby said clean water cleans the mud from the sand particles prior to discharge of the sand through the classified sand outlet.

* * * * *